US005616011A

United States Patent [19]

Witschi

[11] Patent Number: 5,616,011

[45] Date of Patent: Apr. 1, 1997

[54] DEVICE FOR WITHDRAWING FLUIDS FROM TWO SEPARATE SOURCES

[76] Inventor: William A. Witschi, HCR 1699, Benson, Ariz. 85602

[21] Appl. No.: 413,385

[22] Filed: Mar. 30, 1995

[51] Int. Cl.[6] ..... F04B 39/06

[52] U.S. Cl. ..... 417/366; 417/423.14; 415/116

[58] Field of Search ..... 417/423.14, 366, 417/371; 415/116

[56] References Cited

U.S. PATENT DOCUMENTS

| | | | |
|---|---|---|---|
| 2,316,098 | 4/1943 | Moss et al. | 415/116 |
| 2,726,851 | 12/1955 | Krupp et al. | 415/116 |
| 3,762,411 | 10/1973 | Lloyd et al. | 415/116 |
| 3,923,289 | 12/1975 | Danberg | 259/22 |
| 4,239,422 | 12/1980 | Clancy | 415/116 |
| 4,470,753 | 9/1984 | Witzel | 415/116 |
| 5,063,832 | 11/1991 | Mirumachi et al. | 98/2 |
| 5,213,469 | 5/1993 | Mitsch et al. | 415/182.1 |

*Primary Examiner*—Timothy Thorpe
*Assistant Examiner*—Peter G. Korytnyk
*Attorney, Agent, or Firm*—Antonio R. Durando

[57] ABSTRACT

A fluid conveying device has a main housing and a rotor housing which accommodates an impeller. The rotor housing is located inside the main housing and cooperates with the latter to form a motor chamber and an intake chamber. The two chambers are disposed on opposite sides of the rotor housing and communicate with one another via connecting passages. The main housing is provided with apertures which connect the motor chamber to the atmosphere, and a motor for the impeller is mounted in the motor chamber behind the apertures. The main housing is further provided with an outflow opening which faces the intake chamber, and a discharge opening which leads out of the main housing. The outflow opening is connected to a source of gas containing combustible components. The rotor housing has an inlet which opens to the intake chamber and registers with the outflow opening in a non-concentric manner, and an outlet which communicates with the discharge opening. When the motor is switched on, the impeller draws air into the motor chamber via the apertures. The air cools the motor and is then drawn to the rotor housing inlet through the connecting passages. The gas with the combustible components is also drawn to the rotor housing inlet by the impeller. At the inlet, this gas is combined with the cooling air. The impeller expels the resulting mixture from the main housing via the rotor housing outlet and the main housing discharge opening.

13 Claims, 7 Drawing Sheets

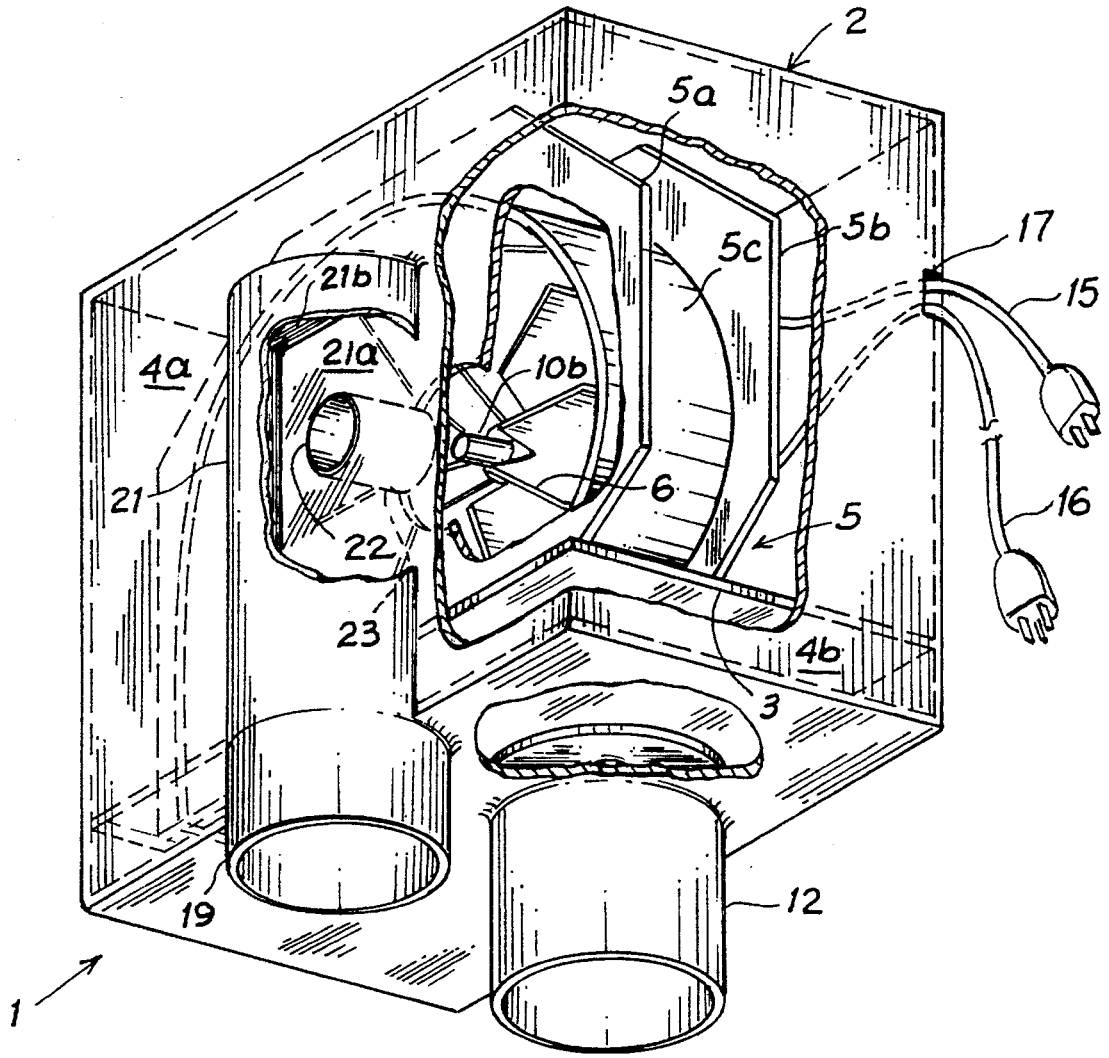
Fig. 1
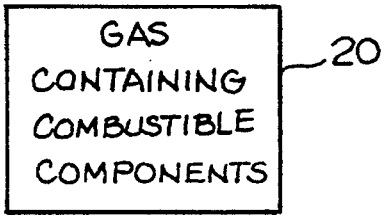

DEVICE FOR WITHDRAWING FLUIDS FROM TWO SEPARATE SOURCES

BACKGROUND OF THE INVENTION

1. Field of the Invention

The invention relates to the conveying of fluids.

2. Description of the Prior Art

Conveying devices find many applications. One example is disclosed in U.S. Pat. No. 3,923,289 which illustrates a fan for mixing solids and liquids on a continuous basis. A fan rotor is housed in a casing having an inlet opening which is coaxial with the axis of rotation of the fan. Additional inlet openings are provided near the periphery of the casing.

U.S. Pat. No. 5,063,832 shows a blower unit for automobile air conditioners. The unit comprises a scroll casing which accommodates a reversible fan as well as a movable guide for changing the direction of air flow. The guide allows the blower unit to be adapted to automobiles having steering wheels on either the left or the right. The blower unit further comprises an intake device which is designed to admit air into the unit along two mutually perpendicular directions.

U.S. Pat. No. 5,213,469 teaches a sewage pump which is designed to limit the particle size of solids drawn into the pump while allowing stringy material to enter the pump. To this end, the pump has an inlet opening consisting of two spaced oval portions which are connected to one another by an essentially rectangular portion.

There are situations in which it is of advantage to simultaneously draw two or more fluids from different sources. Such a situation exists, for instance, when a gaseous mixture containing combustible components is to be evacuated from an area using a fan driven by an air-cooled motor. Here, it is desirable to draw air from the atmosphere around the motor to cool it and to simultaneously draw out the gaseous mixture while keeping the mixture away from the motor. Thus, the motor constitutes a potential source of ignition for the combustible components of the mixture.

At present, there appears to be no fluid conveying device capable of simultaneously drawing from different fluid sources in a simple manner.

BRIEF SUMMARY OF THE INVENTION

It is an object of the invention to provide a relatively simple fluid conveying device which can draw from two or more sources simultaneously.

Another object of the invention is to provide a fluid conveying method which enables fluids to be simultaneously drawn from different sources in a relatively simple fashion.

The preceding objects, as well as others which will become apparent as the description proceeds, are achieved by the invention.

One aspect of the invention resides in a device for conveying fluids. The device comprises a rotor housing having an inlet opening and an outlet opening, and a rotor in the rotor housing for creating suction at the inlet opening and superatmospheric pressure at the outlet opening. The device further comprises first defining means at least in part defining a first flow path between the inlet opening and a first source of fluid, and second defining means at least in part defining a second flow path between the inlet opening and a second source of fluid.

The device of the invention includes at least one flow path for each different fluid source. Accordingly, fluid can be drawn from the respective sources at the same time. Moreover, since the flow paths lead to a common rotor, the device may have a relatively simple design.

Another aspect of the invention resides in a method of conveying fluids. The method comprises the steps of drawing a first stream of fluid along a first flow path from a first source of fluid to a predetermined location, and drawing a second stream of fluid along a second flow path from a second source of fluid to the predetermined location. The method additionally comprises the steps of combining the streams at the predetermined location, and propelling the combined streams away from the predetermined location along a third flow path.

The method can also comprise the step of cooling an object with the first stream upstream of the predetermined location. If the object is capable of initiating combustion, the first stream will be substantially free of combustible material. On the other hand, the second stream may include such material.

The method may further comprise the steps of interrupting the drawing steps, and sealing the third flow path in response to the interrupting step. This makes it possible to prevent backflow.

The method can additionally comprise the steps of resuming the drawing steps, and unsealing the third flow path in response to the resuming step.

BRIEF DESCRIPTION OF THE DRAWINGS

Additional features and advantages of the invention will be forthcoming from the following detailed description of preferred embodiments when read in conjunction with the accompanying drawings.

FIG. 1 is a partly broken away perspective view of one embodiment of a fluid conveying device in accordance with the invention.

DESCRIPTION OF THE PREFERRED EMBODIMENTS

Figure 2:
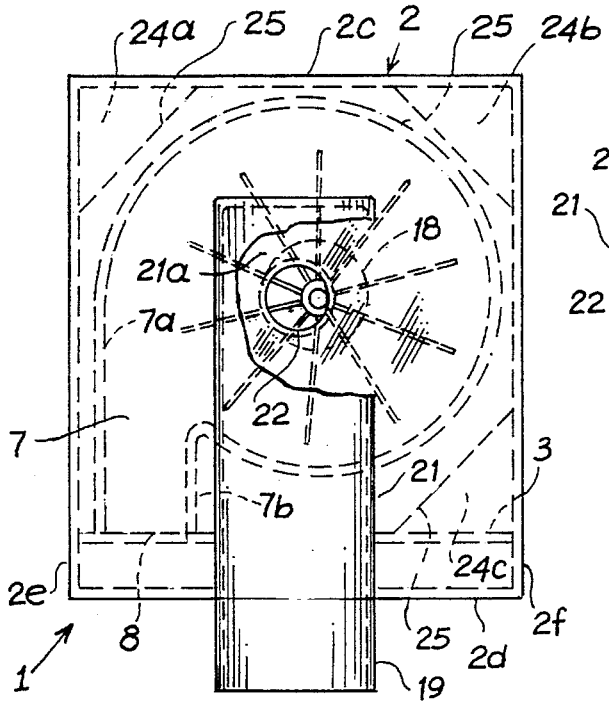
FIG. 2 is a partly broken away front view of the device of FIG. 1.

In FIGS. 1–5, the numeral 1 generally identifies a fluid conveying device according to the invention. The device includes a main housing 2 which is essentially in the form of a rectangular parallelepiped. The housing 2 has a front wall 2*a*, a rear wall 2*b*, a top wall 2*c*, a bottom wall 2*d*, and side walls 2*e* and 2*f*. A partition or wall 3 is located in the main housing 2 near the bottom wall 2*d* and is parallel to the top and bottom walls 2*c*,2*d*. The partition 3 bridges the front and rear walls 2*a*,2*b* and the side walls 2*e*,2*f* and divides the interior of the main housing 2 into an upper compartment 4*a* and a lower compartment 4*b*.

A rotor housing 5 (FIG. 1) is located in the upper compartment 4*a* and accommodates a rotor 6. The rotor housing 5 is made up of a pair of spaced side walls 5*a* and 5*b*, and a peripheral wall 5*c* which spans the gap between the rotor housing side walls 5*a* and 5*b* and extends circumferentially of the rotor 6. The rotor housing side walls 5*a*,5*b* are parallel to the main housing front and rear walls 2*a*,2*b* and bridge the main housing top and bottom walls 2*c*,2*d* as well as the main housing side walls 2*e*,2*f*. The rotor housing peripheral wall 5*c* is constituted by a circular arc, and a pair of straight legs 7*a* and 7*b* which extend downward from the respective ends of the arc to the partition 3. The legs 7*a*,7*b* cooperate with the rotor housing side walls 5*a*,5*b* to define an outlet duct 7 (FIG. 2) having an opening 8 which constitutes an outlet opening of the rotor housing 5. The partition 3 is provided with an opening which registers with the outlet opening 8 and establishes communication between the upper and lower compartments 4*a*,4*b* of the main housing 2.

Figure 3:
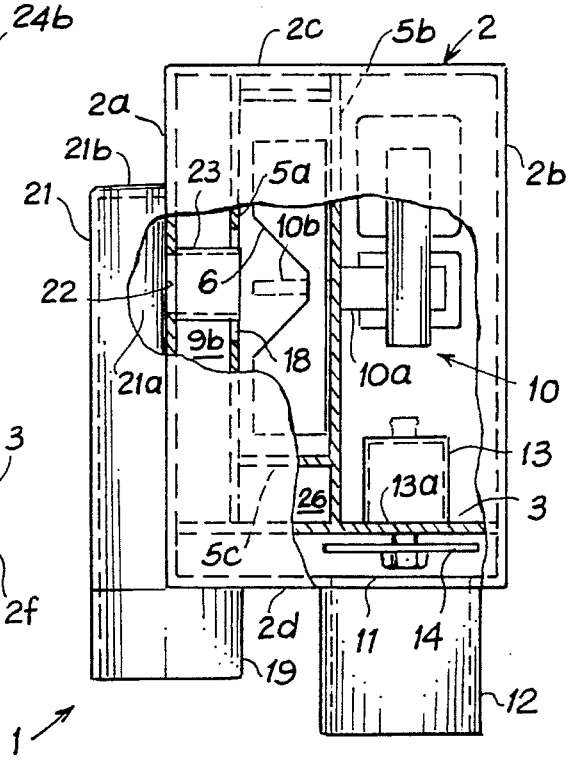
FIG. 3 is a partly broken away side view of the device of FIG. 1.
Figure 4:
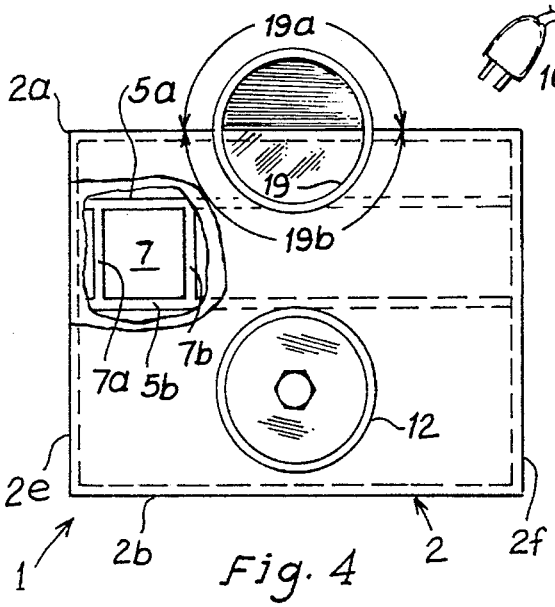
FIG. 4 is a partly broken away bottom view of the device of FIG. 1.
Figure 5:
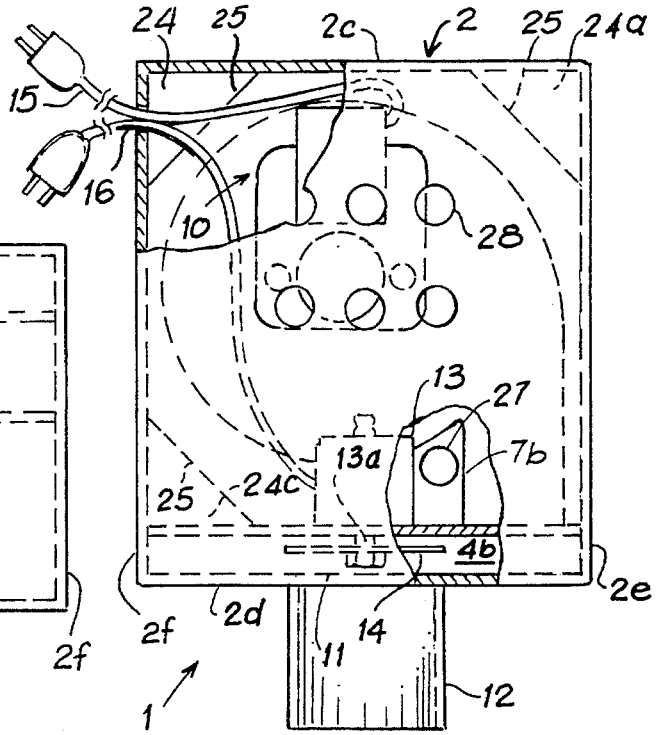
FIG. 5 is a partly broken away rear view of the device of FIG. 1.

The rotor housing side wall 5*b* faces and is spaced from the main housing rear wall 2*b* (FIG. 3). The rotor housing side wall 5*b* cooperates with the main housing rear wall 2*b*, the main housing side walls 2*e*,2*f*, the main housing top wall 2*c* and the partition 3 to define a motor chamber 9*a* in the upper compartment 4*a*. An electric motor 10 is located in the motor chamber 9*a* and is mounted on the rotor housing side wall 5*b* by means of a pair of studs 10*a* (only one of the studs 10*a* is visible in the drawings). The motor 10 has a rotary shaft 10*b* which passes through an opening in the rotor housing side wall 5*b* and projects into the rotor housing 5. The motor shaft 10*b* is fixed to the rotor 6 and serves to drive the rotor 6 in rotation. The motor shaft 10*b* constitutes the axis of rotation of the rotor 6.

The bottom wall 2*d* of the main housing 2 is provided with a circular discharge opening 11 (FIG. 3) which communicates with a cylindrical discharge pipe 12 extending downward from the bottom wall 2*d*. A solenoid 13 is located in the motor chamber 9*a* and has a shaft 13*a* which passes through the partition 3 and projects into the lower compartment 4*b* of the main housing 2. A valve element 14 in the form of a circular disc is affixed to the solenoid shaft 13*a* in the lower compartment 4*b*. The solenoid shaft 13*a* is movable up-and-down lengthwise between a retracted position shown in the drawings and an extended position which is not illustrated. In the retracted position of the solenoid shaft 13*a*, the disc 14 is spaced from the discharge opening 11 and fluid in the lower compartment 4*b* is free to flow into the discharge pipe 12. On the other hand, when the solenoid shaft 13*a* is in its extended position, the disc 14 covers the discharge opening 11 and seals the lower compartment 4*b* from the discharge pipe 12.

The motor 10 is provided with an electrical lead 15 and the solenoid 13 with an electrical lead 16 (FIG. 1). A cutout 17 is formed in the main housing side wall 2*f*, and the leads 15,16 pass through the cutout 17 to the exterior of the main housing 2. The leads 15,16 are here illustrated with plugs for connection to an external source of electricity but could be connected to such a source by means other than plugs.

The rotor housing side wall 5*a* faces and is spaced from the main housing front wall 2*a* (FIG. 3). The rotor housing side wall 5*a* cooperates with the main housing front wall 2*a*, the main housing side walls 2*e*,2*f*, the main housing top wall 2*c* and the partition 3 to define an intake chamber 9*b* in the upper compartment 4*a* of the main housing 2. The rotor housing side wall 5*a* is provided with a circular opening 18 which constitutes an inlet opening of the rotor housing 5 and connects the intake chamber 9*b* with the interior of the rotor housing 5. The inlet opening 18 is centered with respect to the motor shaft 10*b*, and the axis of the inlet opening 18, which passes through the center of the inlet opening 18, is coincident with the motor shaft 10*b*. The intake chamber 9*b* is here considered a first chamber and the motor chamber 9*a* a second chamber.

An intake pipe or conduit 19 extends downward from the bottom wall 2*d* of the main housing 2 and leads to a source of fluid 20 (FIG. 1). The intake pipe 19 is located at the juncture of the main housing front wall 2*a* and the main housing bottom wall 2*d*, and the intake pipe 19 projects radially outward beyond the main housing bottom wall 2*d*. Accordingly, a circumferential segment 19*a* of the intake pipe 19 is disposed laterally of the main housing bottom wall 2*d* while a circumferential segment 19*b* of the intake pipe 19 overlaps the main housing bottom wall 2*d*. The intake pipe segment 19*a* has an extension 21 which runs along the main housing front wall 2*a* from the main housing bottom wall 2*d* towards the main housing top wall 2*c*. The extension 21 is circumferentially incomplete and has an open side which is closed by the main housing front wall 2*a*. The main housing front wall 2*a* cooperates with the extension 21 to define an intake duct 21*a* which constitutes a constricted continuation of the intake pipe 19.

Thus, since the intake pipe segment 19*b* is obstructed by the main housing bottom wall 2*d*, the flow cross section of the intake duct 21*a* is less than the flow cross section of the intake pipe 19. The extension 21 terminates between the main housing bottom wall 2*d* and the main housing top wall 2*c*. The end of the extension 21 remote from the main housing bottom wall 2*d* is closed by a wall 21*b* which is transverse to the extension 21 and normal to the main housing front wall 2*a*.

The contour and cross section of the extension 21 are the same or approximately the same as the contour and cross section of the intake pipe segment 19*a*. In the illustrated embodiment, the intake pipe 19 is cylindrical and the intake pipe segment 19*a* is part-cylindrical. The extension 21 is likewise part-cylindrical, and the radius of curvature of the extension 21 equals or approximates the radius of curvature of the intake pipe segment 19*a*.

The inlet opening 18 (FIGS. 2 and 3) in the side wall 5*a* of the rotor housing 5 is overlapped by the extension 21 and the intake duct 21*a*. The main housing front wall 2*a* is provided with a circular outflow opening or orifice 22 in the region of overlap, and the outflow opening 22 has a smaller diameter than the inlet opening 18. The outflow opening 22 may be non-concentrically offset relative to the inlet opening 18. Thus, the axis of the outflow opening 22, which passes through the center of the outflow opening 22, is parallel to but radially displaced from the motor shaft 10*b* and the axis of the inlet opening 18. The outflow opening 22 is nevertheless at least partly in register with the inlet opening 18.

A short cylindrical outflow tube 23 is mounted on the main housing front wall 2*a* in the intake chamber 9*b*. The outflow tube 23 registers with the outflow opening 22, and the longitudinal axis of the outflow tube 23 coincides with the axis of the outflow opening 22. The outflow tube 23 extends from the outflow opening 22 towards the inlet opening 18 of the rotor housing 5, and the outflow tube 23 may project into the inlet opening 18 as shown or may terminate short of the inlet opening 18. The end of the outflow tube 23 remote from the outflow opening 22, which constitutes the outflow end of the tube 23, confronts the impeller 6.

The motor chamber 9*a* and intake chamber 9*b* (FIG. 3) communicate with one another via three connecting passages 24*a*, 24*b* and 24*c* (FIG. 2) located in the regions of three corners of the main housing 2. These are the corners defined by the main housing side wall 2*e* and the main housing top wall 2*c*, the main housing top wall 2*c* and the main housing side wall 2*f*, and the main housing side wall 2*f* and the partition 3. The connecting passages 24*a*,24*b*,24*c* are formed by providing the rotor housing side walls 5*a*,5*b* with bevels 25 in the respective corner regions.

The rotor housing peripheral wall 5*c* (FIG. 3) is spaced from the partition 3 in the area between the connecting passage 24*c* and the leg 7*b* of the rotor housing peripheral wall 5*c*. The rotor housing peripheral wall 5*c* cooperates with the partition 3 and the rotor housing side walls 5*a*,5*b* to define a channel 26 which runs from the leg 7*b* to the connecting passage 24*c* (FIG. 2). An opening or passage 27 (FIG. 5) is formed in the rotor housing side wall 5*b* adjacent to the leg 7*b*, and the opening 27 connects the motor chamber 9*a* to the channel 26.

The main housing rear wall 2*b* is provided with several apertures 28 which establish communication between the motor chamber 9*a* and the atmosphere. The atmosphere constitutes a source of cooling air for the motor 10 and the solenoid 13.

The fluid source 20 connected to the intake pipe 19 yields a fluid which could be harmful or dangerous if allowed to contact the motor 10 or the solenoid 13. For the purpose of describing the operation of the fluid conveying device 1, it is assumed that the fluid from the source 20 is a gas. It is further assumed that the gas contains at least one combustible or flammable component which could be ignited by the motor 10 or the solenoid 13. To simplify the description, this gas will be referred to as the combustible gas.

The motor 10 is assumed to be off so that the impeller 6 is stationary. Under these circumstances, the disc 14 seals the discharge opening 11 of the main housing 2.

If the motor 10 is now switched on, the impeller 6 begins to rotate. The solenoid 13 is activated simultaneously with the motor 10 and lifts the disc 14 away from the discharge opening 11.

Rotation of the impeller 6 creates a suction force at the inlet opening 18 of the rotor housing 5. Due to this suction force, air is drawn into the motor chamber 9*a* via the apertures 28 (FIG. 5) in the main housing rear wall 2*b*. Streams of the air travel to the inlet opening 18 of the rotor housing 5 along several different flow paths including the following:

1. Through an aperture 28, across the motor chamber 9*a* to the connecting passage 24*a*, through the connecting passage 24*a* to the intake chamber 9*b*, and along the intake chamber 9*b* to the inlet opening 18.
2. Through an aperture 28, across the motor chamber 9*a* to the connecting passage 24*b*, through the connecting passage 24*b* to the intake chamber 9*b*, and along the intake chamber 9*b* to the inlet opening 18.
3. Through an aperture 28, across the motor chamber 9*a* to the connecting passage 24*c*, through the connecting passage 24*c* to the intake chamber 9*b*, and along the intake chamber 9*b* to the inlet opening 18.
4. Through an aperture 28, across the motor chamber 9*a* to the connecting opening 27, through the connecting opening 27 to the channel 26, along the channel 26 to the connecting passage 24*c*, through the connecting passage 24*c* to the intake chamber 9*b*, and along the intake chamber 9*b* to the inlet opening 18.

The motor 10 and the solenoid 13 are each located in or along at least one of the flow paths so that the respective air streams can remove heat from the motor 10 and the solenoid 13.

The suction force at the inlet opening 18 also draws a stream of the combustible gas from the fluid source 20. The combustible gas stream follows a flow path which extends along the intake pipe 19, the intake duct 21*a* and the tube 23 to the inlet opening 18.

At the inlet opening 18, the combustible gas is mixed with the cooling air for the motor 10 and the solenoid 13. The resulting gaseous mixture enters the impeller 6 which transports the mixture towards the outlet opening 8 of the rotor housing 5. The rotation of the impeller 6 causes the pressure to increase over a certain span with increasing distance from the inlet opening 18 so that a superatmospheric pressure exists at the outlet duct 7 and the outlet opening 8.

The pressure rise due to the impeller 6 results in expulsion of the gaseous mixture from the rotor housing 5 and the main housing 2. Thus, the gaseous mixture is propelled along a flow path running through the outlet duct 7 and the outlet opening 8 into the lower compartment 4*b* of the main housing 2, across the lower compartment 4*b* to the discharge opening 11, and through the discharge opening 11 into the discharge pipe 12.

The discharge pipe 12 may lead to the atmosphere or to some other location for disposal of the gaseous mixture.

When the motor 10 is switched off, the impeller 6 stops rotating and the flow of gas through the fluid conveying device 1 is terminated. At the same time that the motor 10 is shut off, the solenoid 13 is deactivated thereby causing the disc 14 to move towards the discharge opening 11 and seal the latter. This prevents backflow from the discharge pipe 12 into the lower compartment 4*b* of the main housing 2.

The fluid conveying device 1 makes it possible to simultaneously draw different fluids from different sources. This enables an object to be subjected to the action of a fluid which is not potentially harmful or dangerous when contacted with the object while a potentially harmful or dangerous second fluid is kept away from the object. Moreover, the fluid conveying device 1 is relatively simple since it has only a single impeller 6.

It has been found that the eccentric positioning of the outflow opening 22 and the outflow tube 23 with respect to the inlet opening 18 and the rotational axis of the impeller 6 allows better suction to be achieved between the fluid source 20 and the inlet opening 18.

The fluid drawn from the fluid source 20 need not necessarily contain a combustible component. For instance, the fluid could be one which is capable of chemically attacking the motor 10 or the solenoid 13. Furthermore, the fluid drawn from the fluid source 20, as well as the fluid drawn through the apertures 28, may be liquids rather than gases.

FIGS. 6–12 illustrate another embodiment of a fluid conveying device in accordance with the invention. In FIGS.

6–12, the same numerals as in FIGS. 1–5 plus one-hundred are used to identify corresponding elements.

The device 101 of FIGS. 6–12 generally resembles the device 1 of FIGS. 1–5. However, there are certain structural differences between the devices 1 and 101 as described below.

Figure 6:
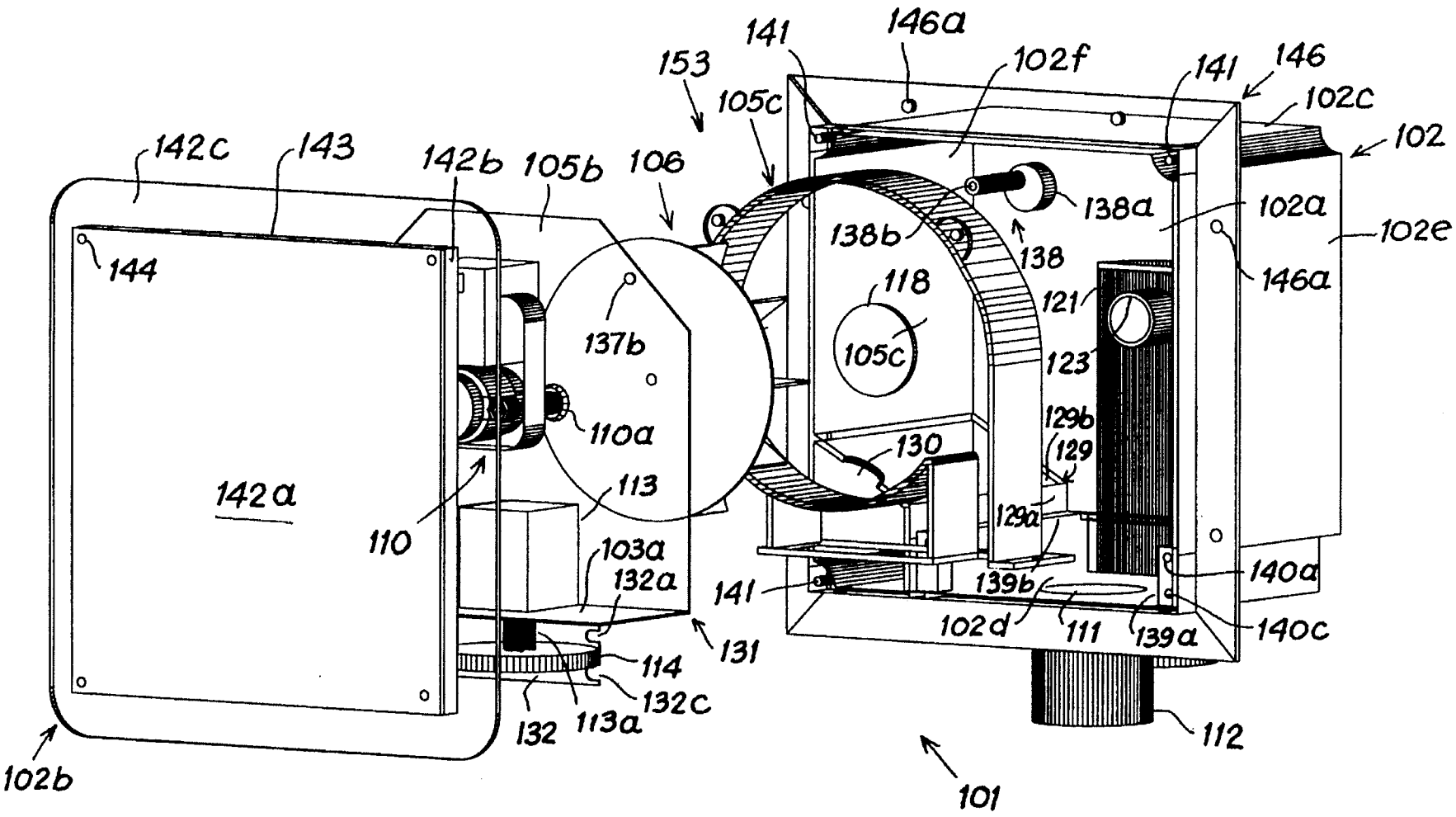
FIG. 6 is an exploded view of another embodiment of a fluid conveying device according to the invention.
Figure 7:
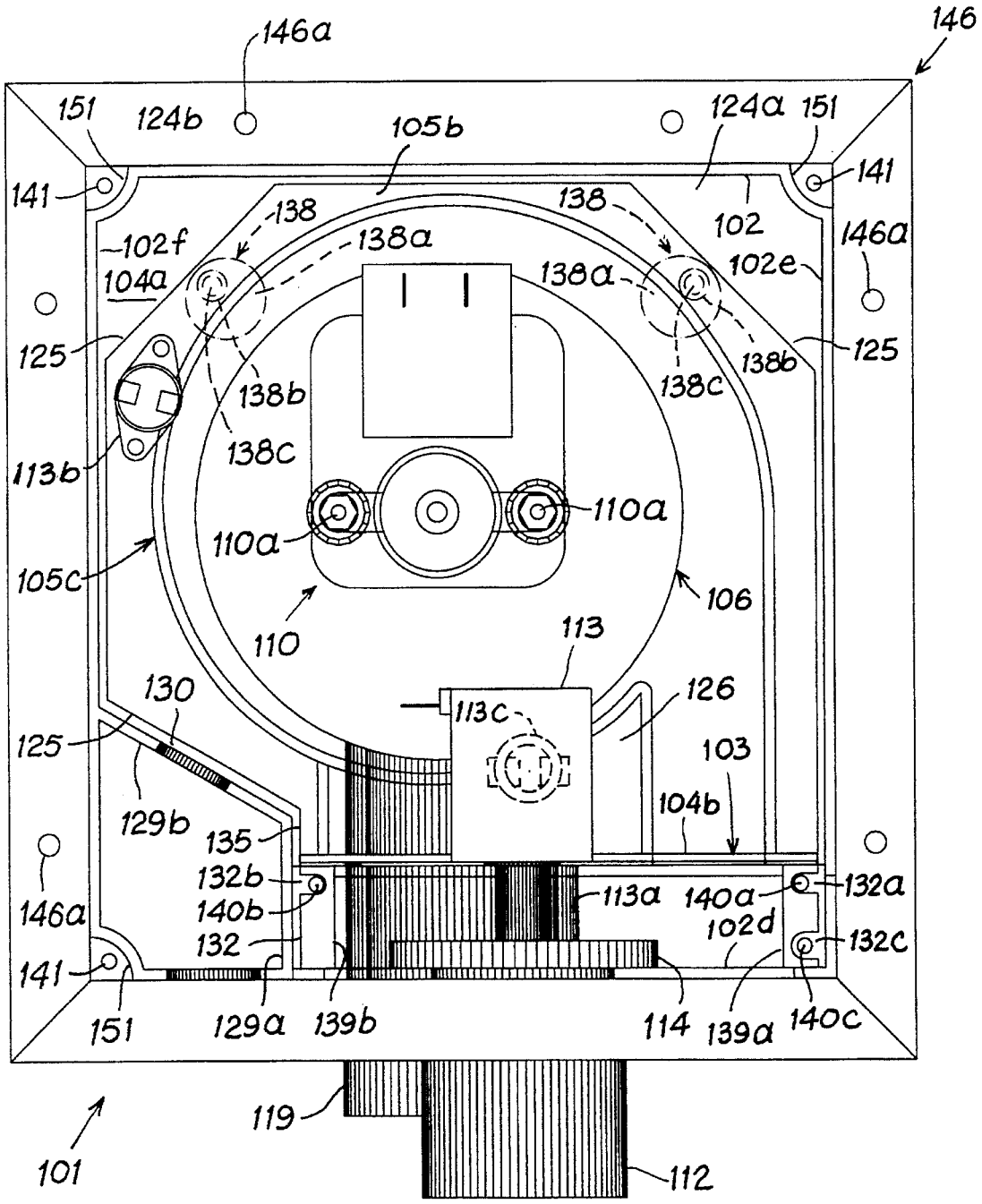
FIG. 7 is a rear view of the device of FIG. 6 with a rear cover of the device removed.
Figure 8:
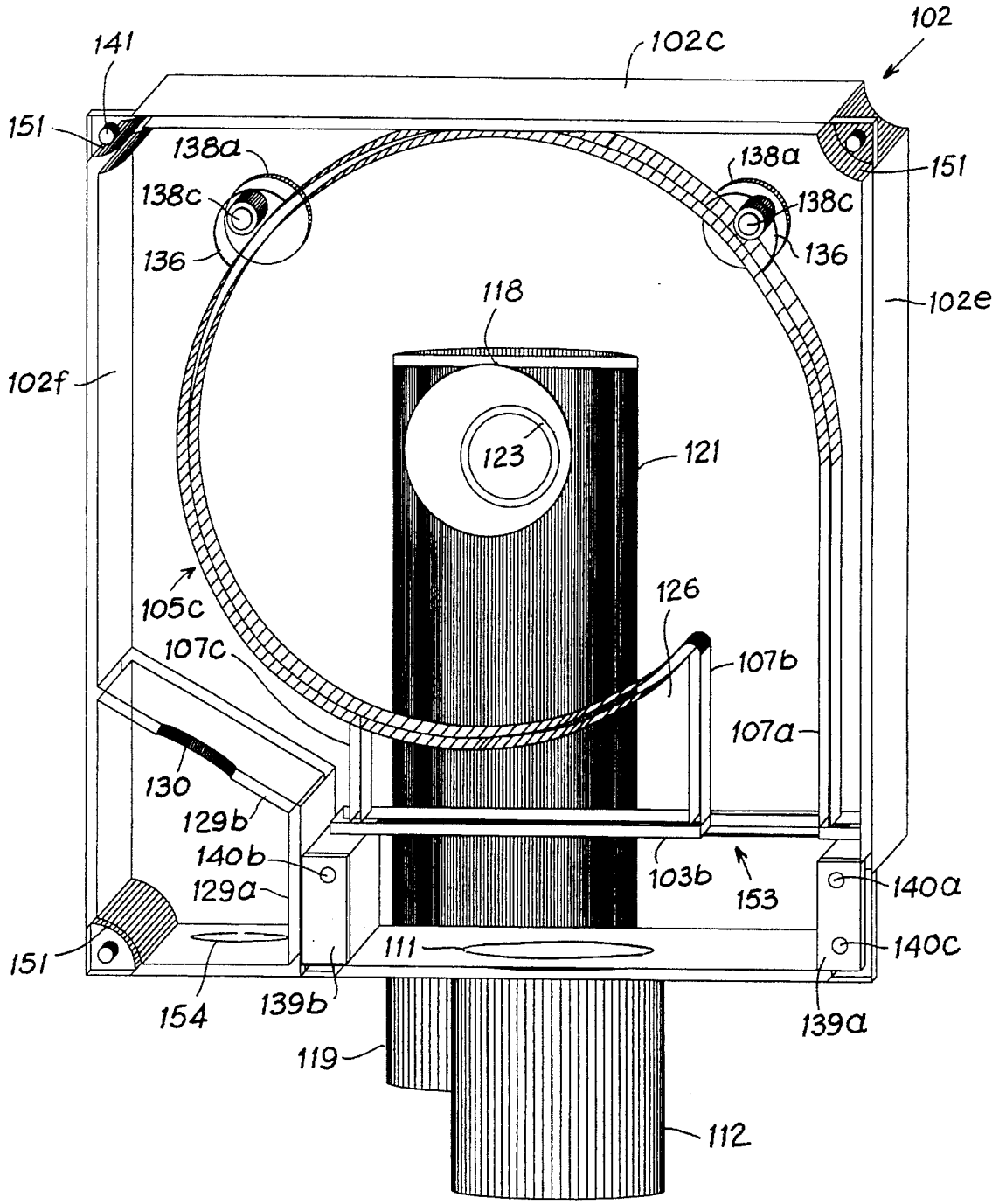
FIG. 8 is a rear view of the device of FIG. 6 with the rear cover and certain internal components of the device removed.

With reference to FIGS. 6–8, the device 101 lacks the connecting opening 27 between the motor chamber 9*a* and channel 26 of the device 1, and no fluid flow takes place in the channel 126 of the device 101. Furthermore, while the channel 26 of the device 1 opens to the passage 24*c* connecting the motor chamber 9*a* with the intake chamber 9*b*, the connecting passage 24*c* is missing in the device 101. In the assembled condition of the device 101, the channel 126 is bounded by the partition 103, the rotor housing side wall 105*b*, the circular arc of the rotor housing peripheral wall 105*c*, the leg 107*b* extending from the circular arc, and a support leg 107*c* for the rotor housing peripheral wall 105*c*. The support leg 107*c*, which runs from the circular arc of the rotor housing peripheral wall 105*c* to the partition 103, is parallel to the leg 107*b* and is spaced therefrom circumferentially of the rotor housing peripheral wall 105*c*.

The device 101 is provided with an enclosure 129 for making electrical connections between the motor 110, the solenoid 113 and an external source of electricity, e.g., the electrical wiring of a building. The enclosure 129 is defined by the main housing front wall 102*a*, the main housing rear wall 102*b*, the main housing side wall 102*f*, the main housing bottom wall 102*d*, a vertical dividing wall 129*a* and an inclined dividing wall 129*b*. The vertical dividing wall 129*a* extends upward from the main housing bottom wall 102*d*, and the inclined dividing wall 129*b* connects the upper edge of the vertical dividing wall 129*a* to the main housing side wall 102*f*. The vertical dividing wall 129*a* is perpendicular to the main housing bottom wall 102*d* and parallel to the main housing side wall 102*f*. On the other hand, the inclined dividing wall 129*b* is perpendicular to the main housing front wall 102*a* and is sloped with respect to the main housing bottom wall 102*d* and the main housing side wall 102*f*.

A cutout 130 is formed at the edge of the inclined dividing wall 129*b* which confronts the main housing rear wall 102*b*. The cutout 130 establishes communication between the enclosure 129 and the motor chamber of the main housing 102 so that wiring can be run from the enclosure 129 to the motor 110, the solenoid 113, and a snap action thermal limit switch for the solenoid 113. Wiring from an external source of electricity can enter the enclosure 129 via an opening 154 provided in the main housing bottom wall 102*d*.

A high temperature limit switch for the entire circuit may be mounted on the rotor housing side wall 105*b* as shown at 113*b* or on the solenoid 113 as indicated in phantom lines at 113*c*. A non-illustrated hot wire runs from the enclosure 129 to the limit switch 113*b* or 113*c* after which it splits into two branches. One of the branches is connected to the solenoid 113 whereas the other of the branches leads to the motor 110. A neutral wire, not shown, connects the motor 110 and the solenoid 113 to a service neutral.

In the device 1 of FIGS. 1–5, the free end of the solenoid shaft 13*a* is threaded and the disc 14 is held on the solenoid shaft 13*a* by a nut. The solenoid shaft 113*a* of the device 101 of FIGS. 6–12 is, in contrast, pressed into the disc 114. This enables better economy to be obtained. The weight of the solenoid shaft 113*a* and disc 114, as well as of the solenoid shaft 13*a* and disc 14, should be sufficient to reliably prevent backflow. A non-illustrated sealing gasket may be attached to the lower side of the disc 114.

The rotor housing 105*a*,105*b*,105*c* of the device 101 is made up of two discrete sections which can be separably connected to one another. One section includes the rotor housing side wall 105*a* and the rotor housing peripheral wall 105*c*. The other section comprises the rotor housing side wall 105*b*.

Figure 9:
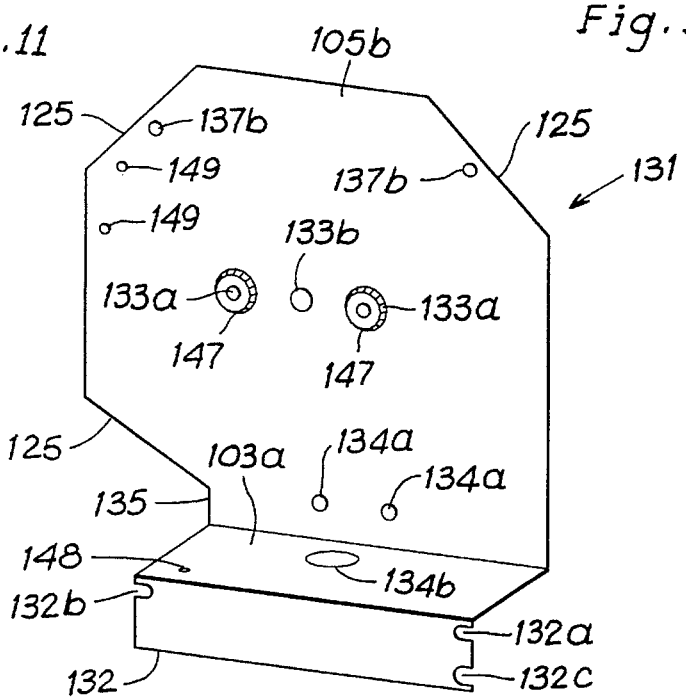
FIG. 9 is a perspective view of a component of the device of FIG. 6, the component including part of a rotor housing.

Referring to FIG. 9, the rotor housing side wall 105*b* constitutes part of a bent plate 131 which is preferably made of metal. In addition to the rotor housing side wall 105*b*, the bent plate 131 includes a platform 103*a* which extends from the bottom edge of the rotor housing side wall 105*b* at right angles to the latter. A skirt 132 projects downward from the edge of the platform 103*a* remote from the rotor housing side wall 105*b*, and the skirt 132 is perpendicular to the platform 103*a* and parallel to the rotor housing side wall 105*b*. The lateral edges of the skirt 132 are provided with notches 132*a*, 132*b* and 132*c*.

Figure 10:
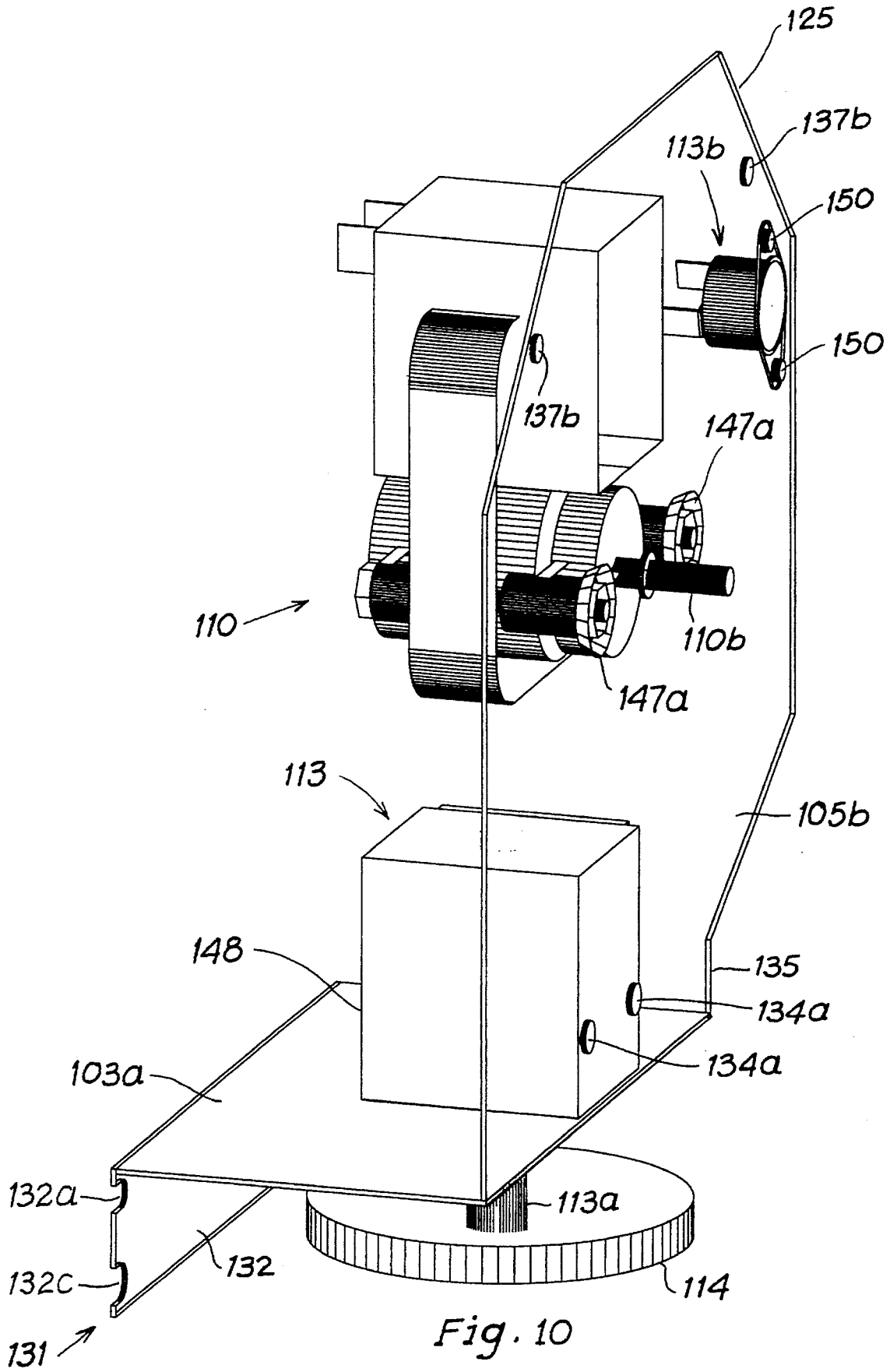
FIG. 10 is a perspective view of the component of FIG. 9 illustrating the mounting of a motor, a solenoid and a limit switch on the component.

Considering FIG. 10 in conjunction with FIG. 9, the motor 110 is mounted on the rotor housing side wall 105*b*. To this end, the rotor housing side wall 105*b* has a pair of holes 133*a* for the motor mounting studs 110*a* and a hole 133*b* for the shaft 110*b* of the motor 110. The holes 133*a* are provided in protrusions 147 which project towards the motor 110 and are formed by indenting the surface of the rotor housing side wall 105*b* facing away from the motor 110. The protrusions 147 define recesses 147*a*, and the mounting studs 110*a* have threaded ends which terminate in the recesses 147*a* when the motor 110 is properly positioned on the rotor housing side wall 105*b*. The motor 110 is secured to the rotor housing side wall 105*b* by nuts which mate with the threaded ends of the mounting studs 110*a*. Due to the protrusions 147 and the recesses 147*a*, the threaded ends of the mounting studs 110*a* need not project into the interior of the rotor housing 105*a*,105*b*,105*c*. This allows the rotor 106 to be located nearer the rotor housing side wall 105*b*.

The solenoid 113 is located on the platform 103*a* adjacent the rotor housing side wall 105*b* and is attached to the latter. Thus, the solenoid 113 has a pair of threaded holes which are alignable with two holes 134*a* in the rotor housing side wall 105*b*. The solenoid 113 is secured to the rotor housing side wall 105*b* by passing screws through the holes 134*a* into the threaded holes of the solenoid 113. The platform 103*a* is provided with a hole 134*b* for the shaft 113*a* of the solenoid 113 and with a screw hole 148 for affixing a non-illustrated ground wire to the bent plate 131.

If the thermal limit switch for the solenoid 113 is to be mounted on the rotor housing side wall 105*b* as shown at 113*b*, two additional holes 149 are formed in the rotor housing side wall 105*b* for this purpose. The limit switch 113*b* can, for example, be secured to the rotor housing side wall 105*b* by pop rivets 150.

The lowermost bevel 125 of the rotor housing side wall 105*b* is designed to lie flush against the inclined dividing wall 129*b* of the enclosure 129. A vertical bearing edge 135 of the rotor housing side wall 105*b* extends between the lowermost bevel 125 and the platform 103*a*, and the bearing edge 135 is arranged to abut the vertical dividing wall 129*a* of the enclosure 129.

Figure 11:
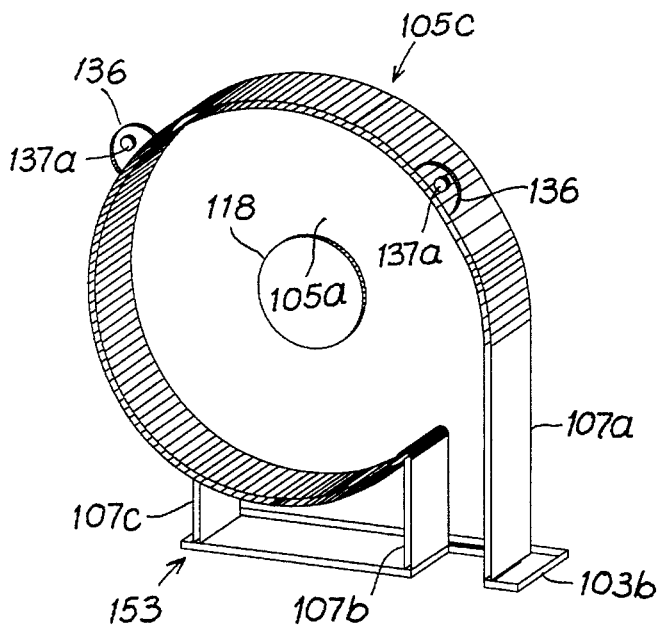
FIG. 11 is a perspective view of a further component of the device of FIG. 6, the component including another part of the rotor housing.

Turning to FIG. 11, the section of the rotor housing comprising the rotor housing side wall 105*a* and the rotor housing peripheral wall 105*c* constitutes part of a unit 153 which is preferably of one piece. In addition to the rotor housing side wall 105*a* and the rotor housing peripheral wall 105*c*, the unit 153 comprises a platform 103*b* which is secured to the ends of the legs 107*a*,107*b*,107*c* remote from the circular arc of the rotor housing peripheral wall 105*c*. The rotor housing side wall 105*a* extends down to the platform 103*b* in the area between the legs 107*a* and 107*b*. Other than in this area, the rotor housing side wall 105*a* terminates flush with the rotor housing peripheral wall 105*c*.

The circular arc of the rotor housing peripheral wall 105*c* has a pair of ears 136 each of which is formed with a hole 137*a*. The ears 136 are situated adjacent the edge of the circular arc remote from the rotor housing side wall 105*a*. The rotor housing side wall 105*b* is provided with two holes 137*b* which are arranged to register with the holes 137*a* when the rotor housing peripheral wall 105*c* and the rotor housing side wall 105*b* are properly seated in the main housing 102.

Turning again to FIGS. 6–8, two projections 138 extend from the inner surface of the main housing side wall 102*a*. Each of the projections 138 includes a disc-like portion 138*a* which is fast with the main housing side wall 102*a* and a cylindrical portion 138*b* which projects from the respective disc 138*a*. The disc-like portions 138*a* are circular and have substantially greater diameters than the cylindrical portions 138*b*. The cylindrical portions 138*b* are provided with holes 138*c* which are designed to register with the boles 137*a* of the rotor housing peripheral wall 105*c* and the holes 137*b* of the rotor housing side wall 105*b*. With the holes 137*b*, 137*a* and 138*c* in alignment, screws are screwed into the holes 138*c* via the holes 137*b* and 137*a*. The screws urge the rotor housing side wall 105*b* against the adjacent edge of the rotor housing peripheral wall 105*c* and also urge the rotor housing side wall 105*a* against the disc-like portions 138*a* of the projections 138. The disc-like portions 138*a* space the rotor housing side wall 105*a* from the main housing front wall 102*a* so that an intake chamber corresponding to the intake chamber 9*b* of the fluid conveying device 1 is formed in the main housing 102.

Two ledges 139*a* and 139*b* are disposed internally of the main housing 102. The ledge 139*a* runs next to the main housing side wall 102*e* from the main housing front wall 102*a* to the main housing rear wall 102*b*. The ledge 139*b*, which is spaced from and parallel to the ledge 139*a*, extends along the vertical dividing wall 129*a* of the enclosure 129 between the main housing front wall 102*a* and the main housing rear wall 102*b*. The platform 103*a* affixed to the rotor housing side wall 105*b* sits on the ledges 139*a* and 139*b* as does the platform 103*b* attached to the rotor housing side wall 105*a* and the rotor housing peripheral wall 105*c*. Each of the platforms 103*a* and 103*b* constitutes a partition segment, and the platforms 103*a* and 103*b* cooperate to define the partition 103 which separates the upper and lower compartments 104*a* and 104*b* of the main housing 102 from one another. The platform 103*a* covers the area bounded by the rotor housing side wall 105*b*, the main housing side wall 102*e*, the main housing rear wall 102*b* and the vertical dividing wall 129*a* of the enclosure 129. The platform 103*b* extends across the area bounded by the rotor housing side wall 105*b*, the main housing side wall 102*e*, the main housing front wall 102*a* and the vertical dividing wall 129*a* of the enclosure 129.

In the assembled condition of the device 101, the rotor housing side wall 105*b* abuts the edge of the rotor housing peripheral wall 105*c* remote from the rotor housing side wall 105*a*. The platform 103*a* of the bent plate 131 extends away from the rotor housing 105*a*,105*b*,105*c* towards the main housing rear wall 102*b*. The skirt 132 of the bent plate 131 overlies the rear end of the lower compartment 104*b* of the main housing 102, i.e., the end of the lower compartment 104*b* facing the rear wall 102*b*.

The ledges 139*a* and 139*b* have end surfaces which face the main housing rear wall 102*b*, and the skirt 132 of the bent plate 131 also overlies these end surfaces. The end surfaces are provided with respective holes 140*a* and 140*b* which register with the notches 132*a* and 132*b* in the skirt 132. By inserting screws into the holes 140*a*,140*b* via the notches 132*a*,132*b*, the bent plate 131 can be releasably connected to the ledges 139*a*,139*b*.

The main housing 102 is generally rectangular when viewed from the rear (FIGS. 7 and 8) and has four corners which are parallel to the ledges 139*a*,139*b* and extend between the main housing front wall 102*a* and the main housing rear wall 102*b*. The ledge 139*a* runs alongside one of these corners and is provided with a hole 140*c* adjacent such corner. The remaining three corners are formed with concavities 151 which make it possible to square off the respective corners by molding. The squared-off corners are provided with holes 141 which open towards the main housing rear wall 102*b*.

The notch 132*c* in the skirt 132 of the bent plate 131 is arranged to register with the hole 140*c* in the ledge 139*a*.

The main housing rear wall 102*b* is in the form of a removable cover. The cover 102*b* comprises a rectangular plate or plate-like portion 142*a* which is bordered by a rectangular lip 142*b*. The lip 142*b* is affixed to a generally rectangular flange 142*c* in such a manner that the lip 142*b* projects rearwardly from the flange 142*c*. A slot 143 is provided in one side of the lip 142*b*, and the slot 143 allows cooling air to flow into the motor chamber of the main housing 102.

The corners of the plate 142*a* of the cover 102*b* are provided with holes 144, and one of the holes 144 is alignable with the hole 140*c* in the ledge 139*a*. Each of the remaining holes 144 of the cover 102*b* is arranged to register with a respective hole 141 of the main housing 102. Thus, the cover 102*b* can be releasably secured to the main housing 102 by screws which pass through the holes 144 into the holes 141 and into the hole 140*c* of the ledge 139*a*. The cover 102*b* is designed to overlie the enclosure 129 as well as the upper and lower compartments 104*a*,104*b* of the main housing 102.

Figure 12:
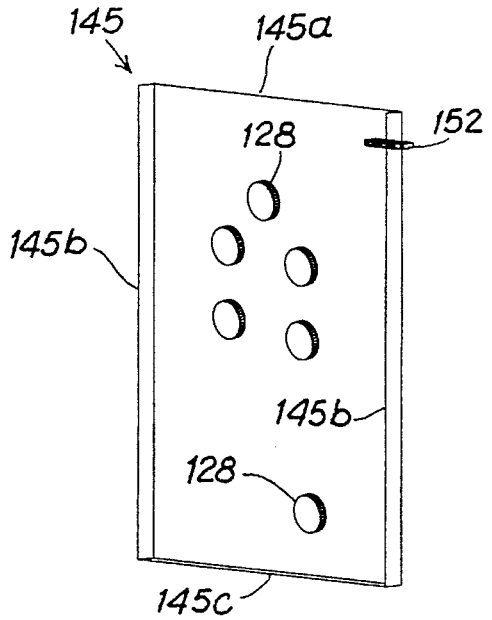
FIG. 12 is a perspective view of an additional component of the device of FIG. 6, the component constituting part of the rear cover of the device.

The plate 142*a* and lip 142*b* of the cover 102*b* cooperate to define a shallow basin which opens to the interior of the main housing 102. An air distributing member 145, shown in FIG. 12, is mounted in the basin. The distributing member 145, which can be made of plastic, is preferably cast into the cover 102*b*.

The distributing member 145 includes a sheet or sheet-like portion 145*a*, and the sheet 145*a* is provided with the apertures 128 which distribute the cooling air entering the motor chamber of the main housing 102. The apertures 128 are arranged such that at least one current of air is directed onto each of the motor 110 and solenoid 113. In the illustrated embodiment, five apertures 128 are placed so as to be positioned around the motor 110 while one aperture 128 is arranged to confront the solenoid 113.

The sheet 145*a* of the distributing member 145 is rectangular, and the distributing member 145 further includes a pair of parallel sealing rims 145*b* which extend along two opposed edges of the sheet 145*a*. The rims 145*b* abut the inner surface of the cover plate 142*a* and are perpendicular to the slot 143 in the cover 102*b*. The distributing member 145 additionally includes a third sealing rim 145*c* which extends along a third edge of the sheet 145*a*. The rim 145*c*, which again abuts the inner surface of the cover plate 142*a*, is parallel to the slot 143. The distributing member 145 is mounted on the cover 102*b* in such a manner that the slot 143 is disposed between the rims 145*b* and adjacent the edge of the sheet 145*a* remote from the rim 145*c*. Hence, air entering the main housing 102 through the slot 143 can flow into the motor chamber of the main housing 102 only by way of the apertures 128.

The rectangular configuration of the cover 102*b* prevents the cover 102*b* from being mounted on the main housing 102 in an orientation which is rotated 90 degrees from the proper orientation of the cover 102*b*. Moreover, the distributing member 145 is provided with a small bar 152 which interferes with the edge 139*b* if an attempt is made to mount the cover 102*b* on the main housing 102 in a position which is rotated 180 degrees from the proper position of the cover 102*b*. To further assure that the cover 102*b* cannot be incorrectly mounted on the main housing 102, one of the holes 144 of the cover 102*b* is offset from the respective corner of the cover plate 142*a* by a different distance than the remaining holes 144. This hole 144 is preferably the one designed to register with the hole 140*c* in the ledge 139*a*.

The main housing 102 is provided with a rectangular flange 146 which frames the main housing 102. Holes 146*a* are formed in the flange 146 to permit attachment of the flange 146 to a support structure by means of nails or screws. For instance, the flange 146 can be used to secure the main housing 102 to wooden or metal wall studs. The flange 146 constitutes a means for mounting the main housing 102 on a support structure.

The manner of assembling the device 101 will be described assuming that the rotor 106, the motor 110, the solenoid 113 and the limit switch 113*c* have been mounted on the rotor housing side wall 105*b*. It is further assumed that the cover 102*b* of the main housing 102 has been removed and that the bent plate 131 with the rotor housing side wall 105*b*, as well as the unit 153 including the rotor housing side wall 105*a* and the rotor housing peripheral wall 105*c*, have been withdrawn from the main housing 102.

The unit 153 is placed in the interior of the main housing 102 through the open rear end of the latter. The unit 153 is positioned in such a manner that the platform 103*b* sits on the ledges 139*a*,139*b* and the rotor housing side wall 105*b* confronts the main housing front wall 102*a* and the projections 138.

While supporting the plunger 113*a* and disk 114 inside the solenoid 113, the bent plate 131 is now inserted in the interior of the main housing 102. The bent plate 131 is positioned with the platform 103*a* on the ledges 139*a*,139*b*, the skirt 132 overlying the rear ends of the ledges 139*a*, 139*b*, and the rotor housing side wall 105*b* facing the rotor housing peripheral wall 105*c*. The lowermost bevel 125 of the rotor housing side wall 105*b* rests on the inclined dividing wall 129*b* while the bearing edge 135 of the rotor housing side wall 105*b* abuts the vertical dividing wall 129*a*.

The unit 153 and the bent plate 131 are fixed to the main housing 102 by inserting screws in the holes 140*a*,140*b* of the ledges 139*a*,139*b* via the notches 132*a*,132*b* of the bent plate 131. Additional screws are screwed into the holes 138*c* of the projections 138 by way of the holes 137*b* in the rotor housing side wall 105*b* and the holes 137*a* in the rotor housing peripheral wall 105*c*. If necessary, the motor 110, the solenoid 113 and the limit switch 113*c* are connected to the wiring in the enclosure 129.

The cover 102*b* is now placed over the open rear end of the main housing 102 and secured to the latter by screws which pass through the holes 144 into the holes 140*c* and 141.

The device 101 may be readily disassembled by removing the screws from the holes 140*c* and 141. The cover 102*b* is then pulled away and the screws in the holes 138*c*, 140*a* and 140*b* removed. Removal of such screws releases the bent plate 131 and the unit 153 from the main housing 102. The motor 110, solenoid 113 and limit switch 113*c* are disconnected from the wiring in the enclosure 129 if necessary and the bent plate 131 and unit 153 withdrawn from the main housing 102.

The construction of the device 101 allows all moving parts to be easily removed for servicing or replacement. The operation of the device 101 is similar to that of the device 1 of FIGS. 1–5.

The terms front, rear, top, bottom, up, down, downward, etc. have been used above solely to simplify the description and are not intended to limit the invention in any manner. Thus, the orientation of the fluid conveying device 1 or 101 can be different from that shown in the drawings. Similarly, the terms atmospheric and superatmospheric are used herein with reference to the pressure in the atmosphere of the operating ambient for the conveying device of the invention. Thus, atmospheric and superatmospheric are to be understood in terms of relative pressures, rather than any specific pressure values.

Various modifications are possible within the meaning and range of equivalence of the appended claims.

I claim:

1. A device for conveying fluids, comprising a rotor housing having an inlet opening and an outlet opening; a rotor in said rotor housing for creating suction at said inlet opening and superatmospheric pressure at said outlet opening; first wall means surrounding a first flow path which extends between said inlet opening and a first source of fluid; and second wall means surrounding a second flow path which extends between said inlet opening and a second source of fluid, said first wall means being at least partly constituted by a main housing having a compartment, and said rotor housing being accommodated in said compartment, said rotor housing and said main housing cooperating to define a first chamber at least part of which is on a first side of said rotor housing and a second chamber at least part of which is on an opposite second side of said rotor housing, and at least one passage being provided inside said main housing to establish communication between said chambers, said first flow path extending through said one passage and at least a portion of each of said chambers.

2. The device of claim 1, wherein said main housing includes a main housing wall and at least part of said main housing wall is located on said second side of said rotor housing, said part of said main housing wall being provided with at least one aperture, and said first flow path extending through said one aperture; and further comprising a motor for said rotor, said motor being located in said second chamber between said one aperture and said one passage.

3. The device of claim 1, wherein said second flow path has an outflow end which opens into said first chamber or into said rotor housing.

4. A device for conveying fluids, comprising a rotor housing having an inlet opening and an outlet opening; a rotor in said rotor housing for creating suction at said inlet opening and superatmospheric pressure at said outlet opening; first wall means surrounding a first flow path which extends between said inlet opening and a first source of fluid; and second wall means surrounding a second flow path which extends between said inlet opening and a second source of fluid, said first wall means being at least partly constituted by a main housing having a first compartment and a second compartment which is connected to said first compartment via said outlet opening, said rotor housing being accommodated in said first compartment, and said second compartment being provided with a discharge opening for expelling fluid from said main housing.

5. The device of claim 4, further comprising a motor for said rotor, a valve element movable between a first position in which said discharge opening is free and a second position in which said discharge opening is sealed, and means for moving said valve element to said first position upon activation of said motor and to said second position upon deactivation of said motor.

6. A device for conveying fluids, comprising a rotor housing having an inlet opening and an outlet opening; a rotor in said rotor housing for creating suction at said inlet opening and superatmospheric pressure at said outlet opening; first wall means surrounding a first flow path which extends between said inlet opening and a first source of fluid; and second wall means surrounding a second flow path which extends between said inlet opening and a second source of fluid, said first wall means being at least partly constituted by a main housing having a compartment, and said second wall means being at least partly constituted by said main housing, said rotor housing being accommodated in said compartment.

7. The device of claim 6, further comprising a motor for said rotor, said motor being disposed along said first flow path.

8. The device of claim 6, wherein said rotor housing comprises a side wall on either side of said rotor, and an additional wall between said side walls extending circumferentially of said rotor.

9. The device of claim 8, wherein said inlet opening is provided in one of said side walls and said outlet opening is provided in said additional wall.

10. The device of claim 6, wherein said rotor comprises an impeller.

11. The device of claim 6, wherein said main housing includes a main housing wall and said second wall means comprises a conduit having an extension which cooperates with said main housing wall to form a duct, said second flow path extending through said duct, and said duct being provided with an outflow orifice which registers with said inlet opening.

12. A device for conveying fluids, comprising a rotor housing having an inlet opening and an outlet opening; a rotor in said rotor housing for creating suction at said inlet opening and superatmospheric pressure at said outlet opening; first wall means surrounding a first flow path which extends between said inlet opening and a first source of fluid; and second wall means surrounding a second flow path which extends between said inlet opening and a second source of fluid, said second flow path having an outflow opening which registers with said inlet opening, and said rotor having an axis of rotation, one of said inlet opening and said outflow opening having a central axis which is substantially coincident with said axis of rotation, and the other of said inlet opening and said outflow opening having a central axis which is substantially parallel to and offset from said axis of rotation.

13. The device of claim 12, wherein said other opening is said outflow opening.

* * * * *